US005363788A

United States Patent [19]

Delrieu

[11] Patent Number: 5,363,788

[45] Date of Patent: Nov. 15, 1994

[54] FLOATING OIL RIG WITH CONTROLLABLE HEAVE

[75] Inventor: Jean-Luc Delrieu, Pau, France

[73] Assignee: Elf Aquitaine Production, France

[21] Appl. No.: 64,033

[22] PCT Filed: Sep. 25, 1992

[86] PCT No.: PCT/FR92/00889

§ 371 Date: May 24, 1993

§ 102(e) Date: May 24, 1993

[87] PCT Pub. No.: WO93/06002

PCT Pub. Date: Apr. 1, 1993

[30] Foreign Application Priority Data

Sep. 26, 1991 [FR] France ..... 91 11865

[51] Int. Cl.[5] ..... B63B 43/06

[52] U.S. Cl. ..... 114/125; 114/267

[58] Field of Search ..... 114/125, 264, 265; 405/195, 203, 204, 205, 208, 209

[56] References Cited

U.S. PATENT DOCUMENTS 4,167,147 9/1979 Bergman ..... 114/122
4,207,828 6/1980 Horowitz et al. ..... 114/265

FOREIGN PATENT DOCUMENTS 2227171 11/1974 France .
2537836 4/1977 Germany .
1594938 8/1981 United Kingdom .

*Primary Examiner*—Jesus D. Sotelo
*Attorney, Agent, or Firm*—Bacon & Thomas

[57] ABSTRACT

Controlled-heave floating oil platform comprising a deck and a floatation assembly. According to the invention, in order to control platform response to sea movement, the floating assembly comprising a rising and falling compartment open to the sea and connected to a gas reservoir by means of a circulation pipe provided with a restriction.

6 Claims, 3 Drawing Sheets

FLOATING OIL RIG WITH CONTROLLABLE HEAVE

The present invention relates to a floating oil rig with controllable heave and, more particularly, to such a rig intended to be installed in a calm sea.

Floating oil rigs of the semi-submersible type are subjected to wave motion, which, during the passage of a wave, causes a vertical movement of the rig which tends to maintain its level of flotation with respect to the surface of the sea. Each sea has it own geographical conditions which give the wave motion associated characteristics: mean height of the waves and frequency of the wave motion. The shape and dimensions of a rig give a specific response time during the passage of a wave. Therefore, in order to avoid resonance problems, it is necessary that the natural periods of the wave motion and of the rig are sufficiently different.

The subject of the present invention is therefore a rig of which one can ensure that the natural period is different from that of the wave motion in which the rig is installed.

In order to achieve this, the invention proposes a floating oil rig with controllable heave, comprising a deck and a flotation unit, which,, in order to control the response of the rig to the motion of the sea in which it is installed, comprises a tidal chamber which is open to the sea and connected to a gas tank by a circulation conduit fitted with a restriction device. According to the invention, the flotation unit comprises two gas tanks arranged on either side, in the vertical plane, of the tidal chamber and connected to it by the circulation conduit.

This type of rig is particularly suitable for calm seas in which the wave motion has a long period, for example the Gulf of Guinea.

According to a second aspect, the invention proposes a rig whose deck comprises bearing cages arranged around its periphery, each bearing cage being intended to receive the end of an associated flotation column, the flotation columns being connected to their associated bearing cages only under the effect of their buoyancy thrust, the columns not being connected together.

Such a structure has advantages of manufacture cost and enables the rig to be assembled directly on site, the flotation columns being manufactured in the region of installation and only the deck being constructed in a remote shipyard. In addition, such a rig can be installed without having to use heavy equipment. The deck is an independent barge which arrives on site fully equipped.

The advantages, as well as the operation of the present invention, will emerge more clearly on reading the following description given in a non-limiting manner with reference to the attached drawings in which.

Figure 1:
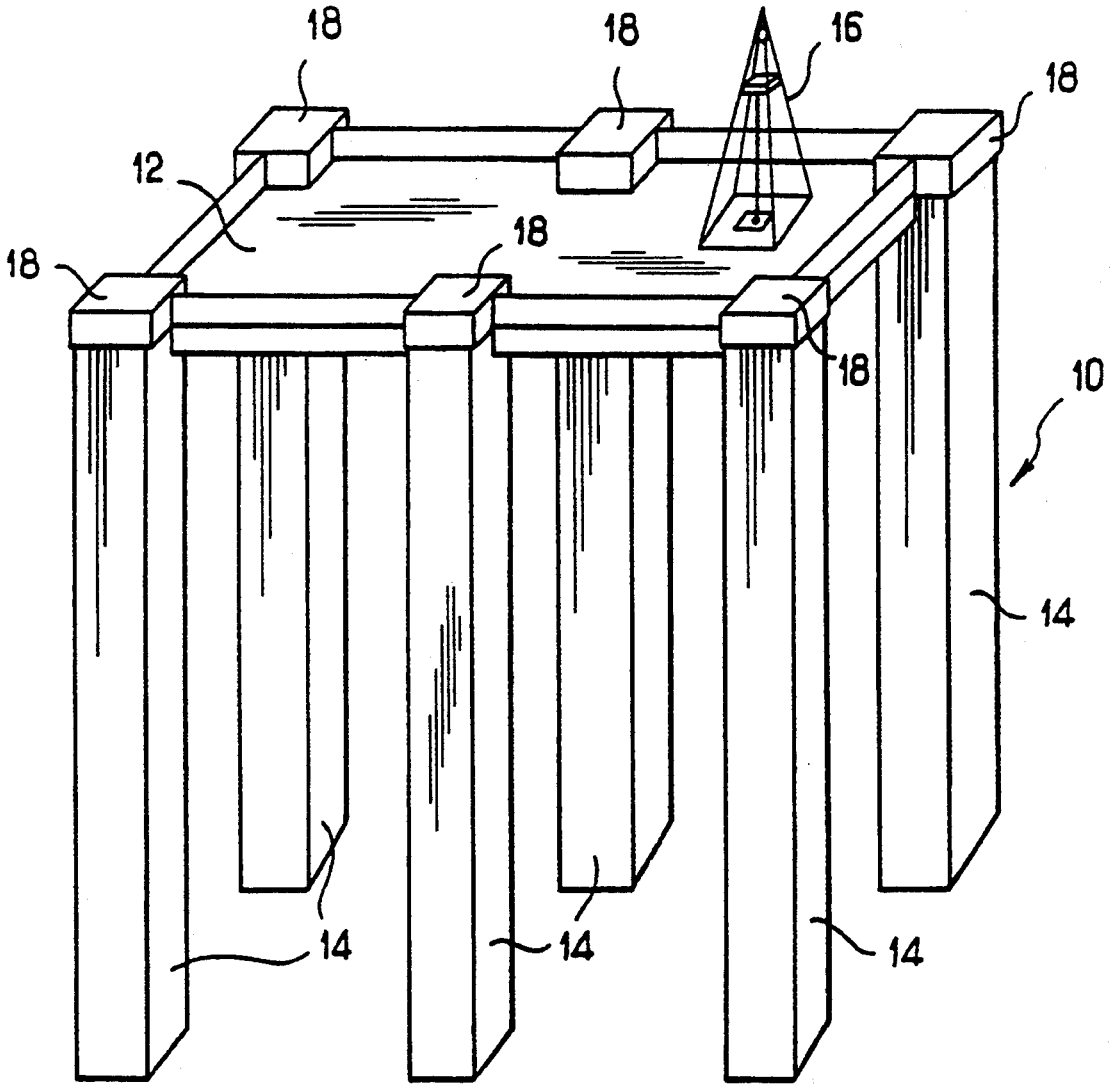
FIG. 1 is a diagrammatical view of an oil rig at sea according to the invention.

In FIG. 1, an oil rig with controllable buoyancy is shown overall as 10. The rig 10 comprises a floating deck 12 which is mounted on the upper ends of flotation columns 14 which form a flotation unit. The rig 10 comprises at least four columns 14 and in the example illustrated, it comprises six of them. The six flotation columns are substantially identical and will be described in more detail hereinafter. The columns may have a rectangular cross-section, or, preferably, a circular cross-section. A drilling mast, shown diagrammatically as 16, is mounted on the deck 12.

Figure 2:
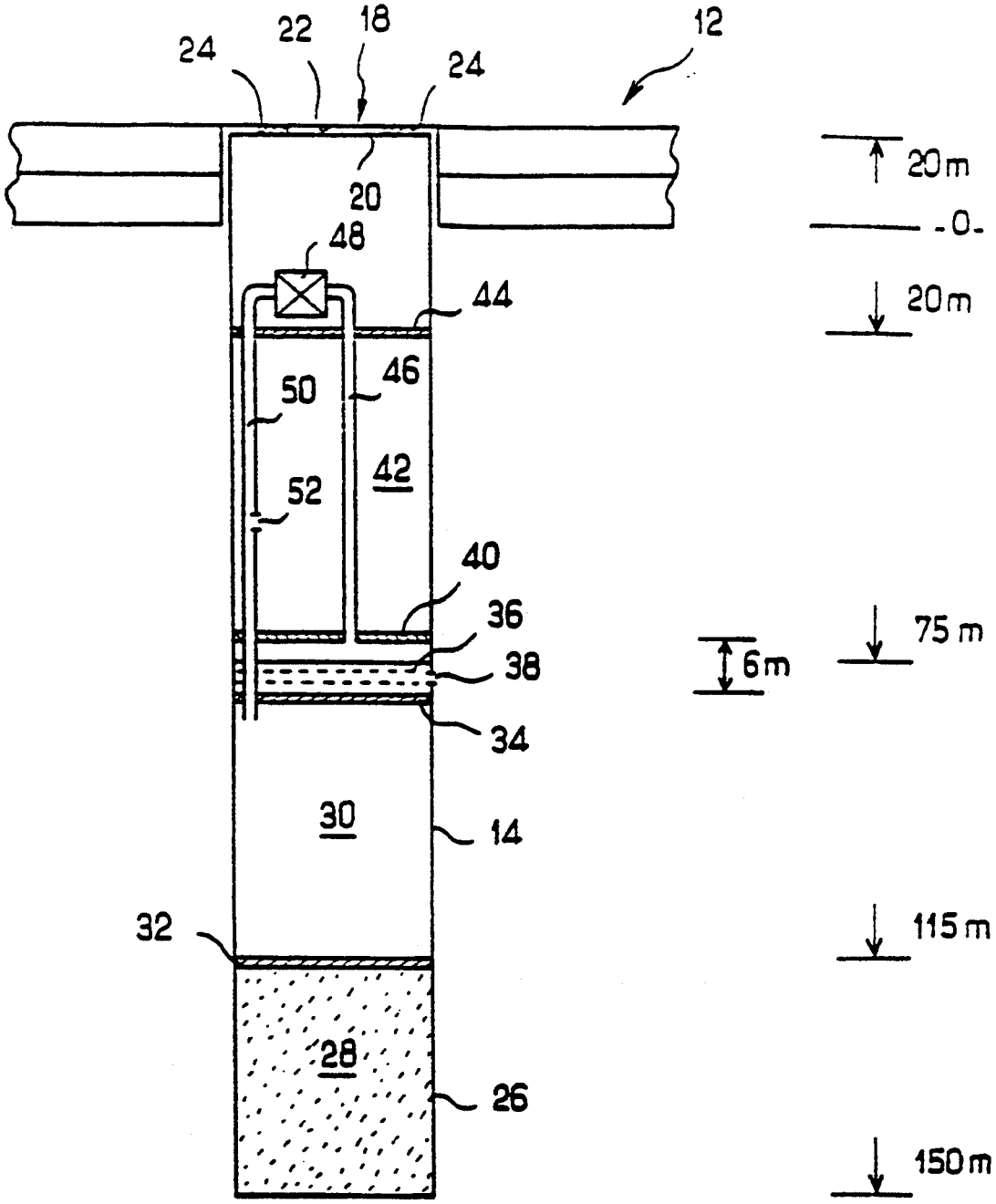
FIG. 2 is a longitudinal section of one of the columns used in the rig of FIG. 1.

The deck 12 is fitted with six bearing cages 18 arranged around its periphery, each one intended to receive the upper end of an associated flotation column 14. As shown in FIG. 2, the upper end 20 of the column 14 bears on the lower surface 22 of the cage 18 via a set of blocks 24 made of elastomer and arranged in a circle on the lower surface 18, which make it possible to distribute the load on the end of the column 14 and which form a joint. Other types of joint, for example a spherical bearing surface, can also be used.

Each column 14, having the form of a tube with closed ends, is preferably made of concrete. In order to give the columns 14 a controllable buoyancy, each one is provided with ballast and with a set of chambers connected together by passages forming a damping system.

At the lower end, looking at the drawing of the column, there is formed a ballast chamber 26, containing ballast 28 and separated from a first gas tank 30 by a partition 32. A second partition 34 separates the first tank 30 from a tidal chamber 36, which is open to the outside of the column 14 through an opening 38 and delimited by a third partition 40. A second gas tank 42 is defined between the third partition 40 and a fourth partition 44. A gas circulation conduit 46 passes through the second tank 42 in a sealed manner, and connects the tidal chamber 36 to a valve 48 forming a calibrated orifice. The valve 48 is connected by a gas circulation conduit 50 to the first tank 30, the conduit 50 also communicating with the second tank 42 via an opening 52. The first and second tanks 30, 42 can contain an inert gas such as nitrogen, but, in a preferred example, they contain air.

The way in which the columns 14 operate will now be examined taking as an example an oil rig in which the dimensions of the deck 12 are 80 m×50 m×15 m. For such a rig, each column 14 has a length of 170 m, a diameter of 18 m and is made of concrete having a thickness of 60 cm. In order to ensure that the centre of gravity of the column 14 is located below the centre of buoyancy thrust, the column is weighted with 22,000 T of ballast which, in the example illustrated, is iron ore having a relative density of 3.3. The ballast chamber has a height of approximately 35 m corresponding to that of the first tank 30. The second tank has a height of approximately 50 m and the opening 38 is located at approximately 95 m from the upper end of the column, which corresponds to a depth under the surface of the water of approximately 75 m.

Since the opening 38 is located 75 m below the surface of the sea, the water enters the tidal chamber 36, compressing the air inside the tanks 30, 36 and 42 until there is pressure equilibrium between the air and the water at a depth of 75 m. The pressure stabilises at 7.5 bars above atmospheric pressure, the tidal tank being partially filled with water as shown in FIG. 2. During the passage, above the column 14, of a wave having, for example, a height of 3 m with respect to the mean level of the sea, the pressure prevailing in the tidal tank 36 increases from 7.5 to 7.6 bars, the additional pressure due to the wave decreasing with depth. It is 0.3 bar at the surface and much less at 75 m, depending on the period of the wave. The water enters the tidal chamber and the air displaced from the latter by this additional pressure passes via the conduit 46 and the valve 48 towards the tanks 30 and 42. Since the valve 48 forms a calibrated orifice, the passage of air towards the tanks 30 and 42, and thus the equalisation of the pressures inside the column, are delayed with respect to the passage of the wave. Next, the wave passes by and the pressure prevailing in the tidal chamber 36 decreases from 7.6 bars to 7.5 bars. The air in the tanks 30 and 42 is at an excess pressure with respect to the tidal chamber 36 causing the air to move via the conduits 50 and 46 and the valve 48 from the tanks 30 and 42 towards the tidal chamber 36. This passage of air is also slowed down by the calibrated orifice. The water leaves the tidal chamber with a delay in relation to the crest of the wave.

Thus, the damping system arranged inside each column 14 makes it possible to lengthen the natural period of the movement of the rig 10 resulting from the passage of the wave so that the natural period of the wave and that of the rig are different. In the example illustrated, in which the rig is intended to be installed on a sea where the mean natural period of the centennial wave motion is 18 seconds, the damping system makes it possible to lengthen the natural periods to 35 or 40 seconds and to dampen the vertical movements to 45% of critical damping.

The manufacture and commissioning of the rig described hereinabove will now be examined.

The floating deck 12 and the six columns 14 are manufactured separately and are then towed to the site where the rig will be installed. The floating deck 12 comprises a barge. The columns 14 are towed empty, arranged horizontally on a barge, and are then lowered into the water on the site. The columns 14 are then weighted with sea water so that they assume a vertical position. Each column is loaded with ballast from an ore carrier and an additional quantity of sea water is then introduced into the column so that it has a height above the water line of approximately 5 m. Once the six columns 14 are weighted, the deck 12 is placed in its position between the columns so that the upper ends 20 are each located adjacent to the associated bearing cage 18. The water in each column 14 which formed the additional ballast is forced out, increasing the height above the water line of the columns from 5 m to 20 m, and thus raising the deck 12 from the surface of the sea.

Considering the fact that the height of the centennial wave motion is small in the Gulf of Guinea, the lower part of the deck does not have to be very high above the water, and this increases stability. In addition, the centre of the buoyancy thrust of each column is located well above its centre of gravity, which gives the columns great stability. The columns 14 are connected to the deck 12 only under the effect of their own buoyancy thrust, bearing on the joints arranged in the bearing cages 18.

It should be noted that the columns 14 are not connected together, which enables them to move angularly to a certain extent under the effect of the current and of the wave motion.

The simplified structure of the rig according to the present invention enables it to be assembled directly on site, without having to use a derrick barge or other heavy equipment. The floating deck 12 arrives fully equipped on site, and this saves considerable time and money. In addition, the nature of the rig makes it possible to install the well heads on the rig instead of on the seabed, and this has significant advantages.

The valve 48 forming the restriction device for the passage of air has an adjustable opening making it possible to respond to variable conditions of the wave motion.

Figure 3A:
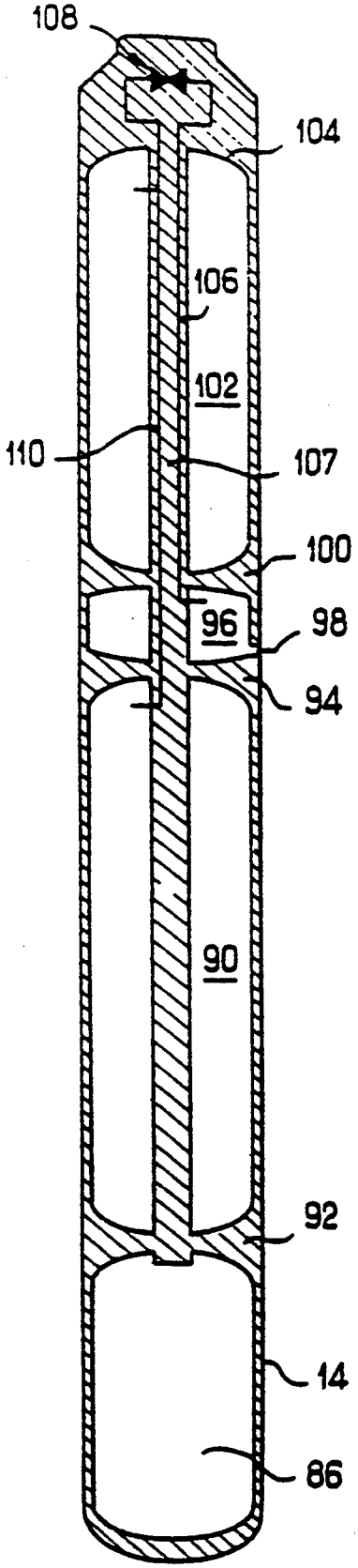
FIGS. 3A and 3B are each a longitudinal section of a column according to a second embodiment of the invention.
Figure 3B:
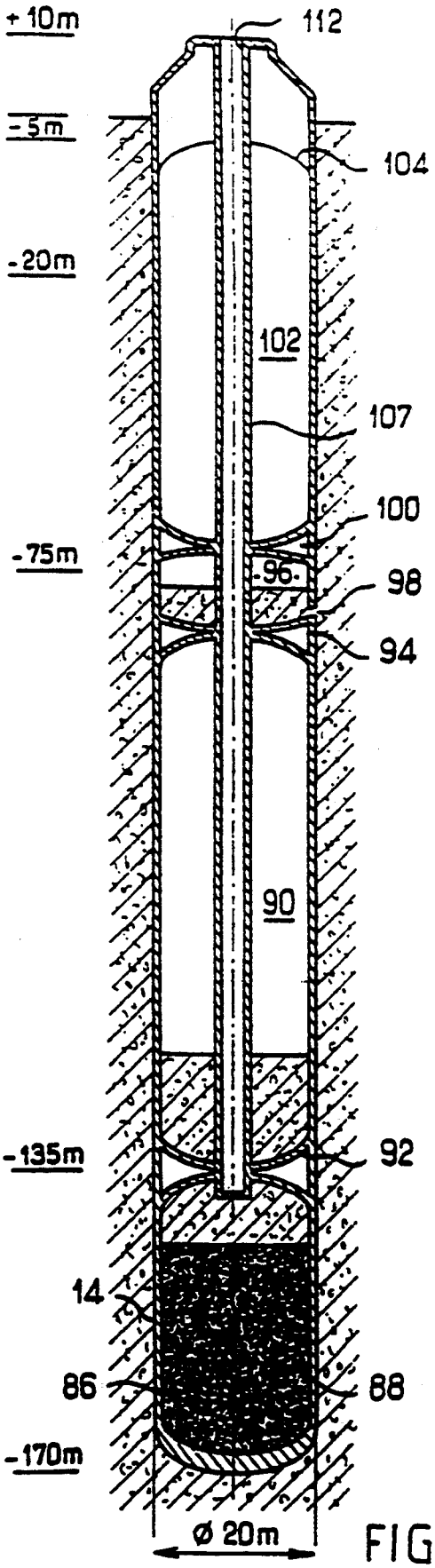

FIGS. 3A and 3B show a second embodiment of the invention.

At the lower end, looking at the drawing, of the column 14, there is formed a ballast chamber 86, containing ballast 88 and separated from a first gas tank 90 by a partition 92. A second partition 94 separates the first tank 90 from a tidal chamber 96, which is open to the outside of the column 14 through an opening 98 and delimited by a third partition 100. A second gas tank 102 is defined between the third partition 100 and a fourth partition 104. A gas circulation conduit 106 passes through the second tank 102 in a sealed manner via a conduit 107 and connects the tidal chamber 96 to a valve 108 forming a calibrated orifice. The conduit 107 enables the ballast chamber to be filled via an opening 112. The valve 108 is connected by a gas circulation conduit 110 to the first tank 90. The first and second tanks 90, 102 can contain an inert gas such as nitrogen but, in a preferred example, they contain air.

The operation of this type of column is substantially analogous to that of the previous embodiment.

I claim:

1. Floating oil rig with controllable heave, comprising a deck and a flotation unit which, in order to control the response of the rig to the motion of the sea in which it is installed, comprises a tidal chamber which is open to the sea and connected to a gas tank by a circulation conduit fitted with a restriction device wherein the flotation unit comprises two gas tanks arranged on either side, in the vertical plane, of the tidal chamber and connected to it by the circulation conduit.

2. Rig according to claim 1, wherein the flotation unit comprises at least four flotation columns, each one comprising a tidal chamber.

3. Platform according to claim 2, wherein the deck comprises bearing cages arranged around its periphery, each bearing cage being intended to receive the end of an associated flotation column.

4. Rig according to claim 3, wherein the flotation columns are connected to their associated bearing cages only under the effect of their buoyancy thrust, the columns not being connected together.

5. Rig according to claim 3, wherein each bearing cage is fitted with a joint against which the associated flotation column bears.

6. Rig according to claim 1, wherein the deck comprises an independent barge.

* * * * *